United States Patent [19]

Romanski et al.

[11] 4,403,632

[45] Sep. 13, 1983

[54] CORRUGATOR BELT WITH HIGH AIR PERMEABILITY

[75] Inventors: Eric R. Romanski, Delmar; Michael J. Josef, Clifton Park, both of N.Y.

[73] Assignee: Albany International Corp., Albany, N.Y.

[21] Appl. No.: 245,360

[22] Filed: Mar. 19, 1981

[51] Int. Cl.[3] ..... D03D 11/00; D21F 11/12

[52] U.S. Cl. ..... 139/383 A; 139/409; 198/846

[58] Field of Search ..... 139/383 A, 383 AA, 425, 139/408, 409, 412, 413; 198/844, 846, 847; 162/DIG. 1

[56] References Cited

U.S. PATENT DOCUMENTS

| | | | |
|---|---|---|---|
| 1,963,898 | 6/1934 | Hainsworth | 139/408 |
| 2,865,408 | 12/1958 | Vollrath | 139/408 |
| 3,957,090 | 5/1976 | Muhlen et al. | 139/409 |
| 4,141,388 | 2/1979 | Romanski et al. | 139/383 A |
| 4,186,780 | 2/1980 | Josef et al. | 139/383 A |
| 4,261,392 | 4/1981 | Westhead | 139/383 A |

FOREIGN PATENT DOCUMENTS

| | | | |
|---|---|---|---|
| 72514 | 10/1916 | Austria | 139/409 |
| 246735 | 2/1926 | United Kingdom | 139/408 |
| 1220531 | 1/1971 | United Kingdom | 139/383 A |

*Primary Examiner*—James Kee Chi

*Attorney, Agent, or Firm*—Kane, Dalsimer, Kane, Sullivan and Kurucz

[57] ABSTRACT

The disclosure is of a multi-layer, flat woven, composite fabric having a duplex weave base of synthetic, polymeric resin yarns and soft surfaces of multi-filament or spun yarns. The fabric is useful as a conventional corrugator belt when made endless.

10 Claims, 6 Drawing Figures

CORRUGATOR BELT WITH HIGH AIR PERMEABILITY

BACKGROUND OF THE INVENTION

1. Field of the Invention

The invention relates to corrugated paper board manufacture and more specially relates to corrugator belt textile fabrics for the manufacturing of corrugator paper board on a corrugator machine.

2. Brief Description of the Prior Art

Corrugated paper board manufacture is described in U.S. Pat. No. 3,368,933. As described therein the corrugator belts employed to transport the web of corrugated board through the corrugator machine "should be strong and durable with good dimensional stability under the conditions of tension, high temperature, etc. encountered in the heating and cooling sections of the machine. The belts also must be comparatively flexible in the longitudinal or machine direction while retaining sufficient rigidity in the cross-machine direction to facilitate the guiding of the belts along their endless paths. In addition, the belts preferably should have sufficient porosity to permit the free transmission of vapor therethrough but at the same time should be sufficiently incompatible with moisture to avoid the adsorption of condensed vapor which might otherwise rewet the surfaces of the corrugated product.

In the U.S. Pat. No. 3,368,933 a corrugator belt is made from a perforated sheet of a polymeric resin. However, such belts do not perform well over wide ranges of operating temperatures, whereas textile fabric based belts do. The corrugator belts of the prior art made from textile fabrics have not always met the desired requirements of a corrugator belt in all respects. For example, the textile corrugator belts of the prior art are generally coarse weaves. They are relatively heavy fabrics and belts made therefrom are heavy belts requiring large amounts of power to drive them on the corrugator machines. The heavier prior art belts are also relatively inflexible and difficult to guide and track thorogh the corrugating machine. Further, the prior art corrugator belts generally have low permeabilities, i.e.; on the order of 4 to 10 CFM. At such low permeabilities, moisture passage is difficult if not impossible.

The textile fabric of our invention is flat woven and has all of the frictional surface characteristics desired for a corrugator belt fabric used in the manufacture of corrugator paper board on a corrugator machine.

The fabrics of the invention exhibit high permeability, i.e.; in the order of at least 10 and up to 2000 CFM. The retention or inhibition of vapor passage is minimal. Their light weight reduces power demands needed for driving belts made of the fabrics of the invention. The monofilament construction of belts made from fabric of the invention provides a diagonal mobility, aiding in their guidability on the corrugator machine.

Corrugator belts made from the fabric of the invention have also demonstrated increased drying rates for the corrugator machine, in operation. This is of course an economic advantage, reducing energy and steam requirements for a given production run. In addition, the fabric of the invention has the structural integrity required to join together the ends of the fabric in a conventional pin seam. Corrugator belts prepared from the embodiment fabrics of our invention combine the properties of an all monofilament belt including the ease of guiding, lightness, high permeability, superior strength, pin seam capabilities and having a smooth, non-marking, frictional surface (to avoid slippage between the belt and board).

SUMMARY OF THE INVENTION

The invention comprises a multi-layer, flat woven, composite fabric useful in forming the body of an endless corrugator machine belt, which comprises;

a multi-layer base of interwoven, synthetic polymeric resin yarns;

said base being sandwiched between surface layers, at least one of which is interwoven, soft textile yarns;

said layers of soft textile yarns being interconnected to the base by an interweaving of the soft textile yarns with the base yarns.

The term "soft textile yarns" as used herein means yarns of spun or multifilament textile fibers. They may be texturized or bulked yarns also.

In a preferred embodiment, the fabric of the invention is binder free. The term "binder free" as used herein means that the composite fabric of the invention is a unitary structure free of elements joined by binder yarns alone.

DETAILED DESCRIPTION OF THE PREFERRED EMBODIMENTS OF THE INVENTION

Those skilled in the art will readily appreciate the invention from the following discussion of the preferred embodiments when read in conjunction with the accompanying drawings of FIGS. 1 through 6, inclusive.

Figure 1:
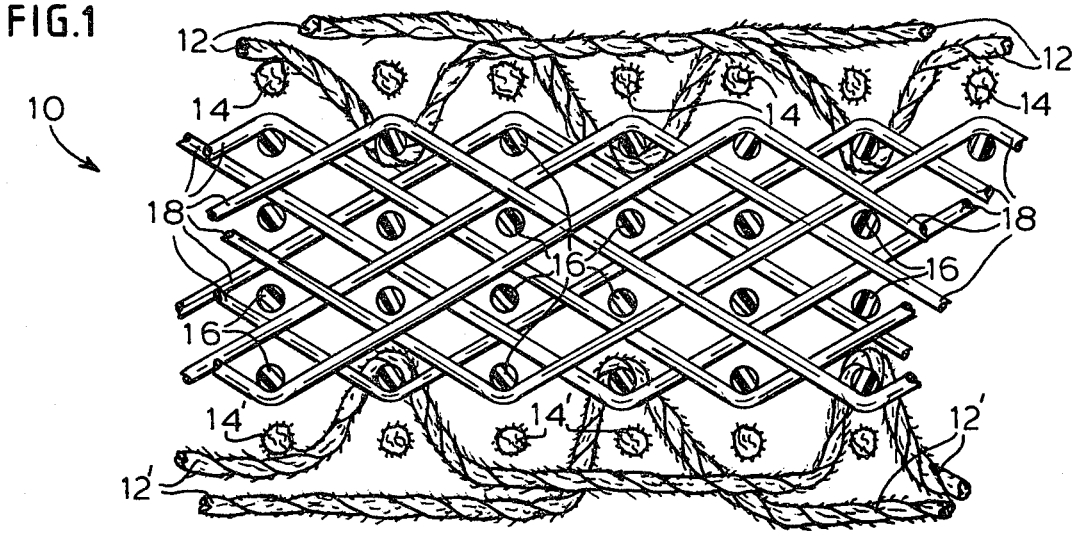
FIG. 1 is a cross-sectional side elevation of a portion of a length of embodiment fabric of the invention.

Referring first to FIG. 1, a cross-sectional side elevation is seen of a portion of a length of embodiment fabric 10 of the invention. The fabric 10 is a multi-layer fabric free of binder yarns. Each of the upper and lower surfaces of the fabric consists of a single layer of interwoven spun yarns formed by the weaving of lengthwise or warp spun yarns 12 or 12' and crosswise or filler spun yarns 14 or 14'. The spun yarns 12, 12', 14 and 14' may be any of the commercially available spun yarns. Alternatively, the yarns 14 and 14' may be multifilament yarns or they can be texturized multifilament yarns or bulked yarns. The yarns may have a size ranging from 100 grains to 3,000 grains per 100 yards. Generally, such yarns are represented by yarns of heat resistant, natural or synthetic staple fibers such as fibers of polyester, polyamide, polyacrylic, wool and like fibers and blends thereof. Those skilled in the art will appreciate that the degree of softness desired in the fabric surface may be controlled by selection of particular fibers in the yarns and by the amount of twist put into the yarns during their preparation.

The soft yarn surfaces provide a heat barrier for the fabric of the invention and tends to protect the base yarn which is otherwise susceptible to degradation. The spun yarns 12, 12' 14 and 14' on the back and face surface of the fabric 10 also provides a frictional surface to aid in driving the belt fabricated thereon, from the back side and in engaging the web of corrugated (board) on the face side.

Figure 5:
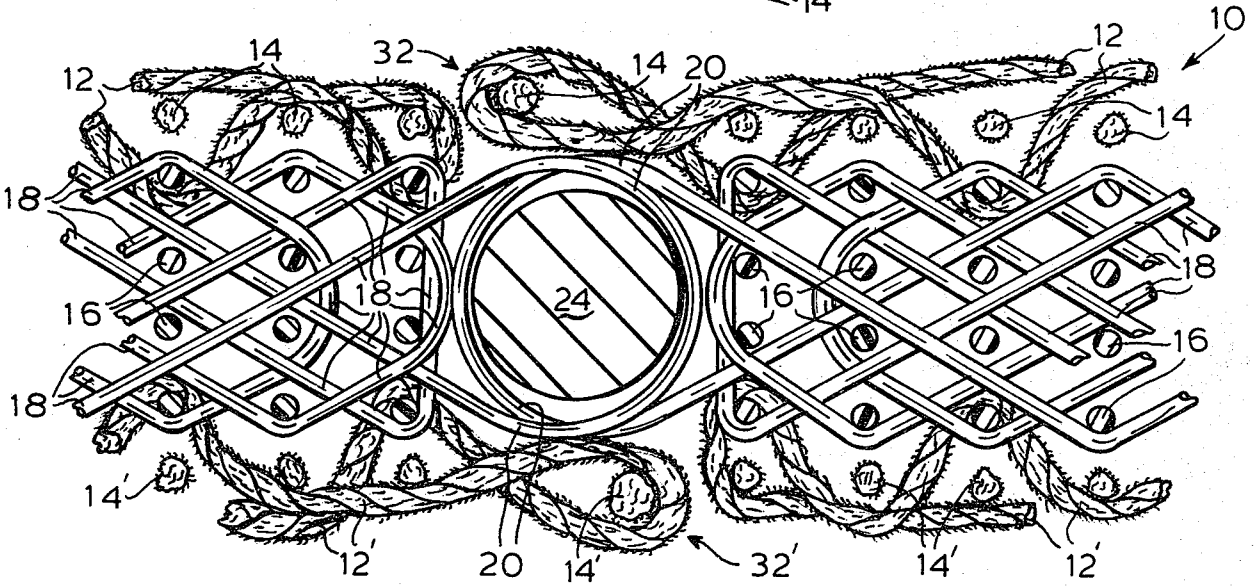
FIG. 5 is a view as in FIG. 4 of another joinder of the ends of the fabric of FIG. 1 to make an endless belt.

As shown in FIG. 1, the base or core of the preferred fabric 10 consists of a 4-layer weave of lengthwise (warp) monofilament yarns 18 and crosswise (weft) monofilament yarns 16. The core of interwoven monofilament yarns provides a high degree of stability and structural integrity to the fabric 10 of the invention. However, the base structure is not limited to monofilament yarns. Yarns 16, 18 may also be twisted multifilament yarns, spun yarns or composites of all three categories of yarn. These yarns may also be chemically treated or specially coated yarns to obtain special characteristics such as air permeability. The open weave structure promotes passage of moisture generated by drying of the glue in the flutes of the corrugated board being carried. Any commercially available yarns having a diameter within the range of from about 0.008 to 0.040 inches may be employed as the yarns 16, 18. Representative of such yarns 16, 18 are monofilaments of polyamide, polyester, polypropylene, polyimide and the like. As shown in FIG. 5, a number of lengthwise yarns 18 are provided having loops 20 at the fabric ends. The loops 20 are formed by conventional techniques well known to those skilled in the art and provide a means of forming a joinder and seam between the two ends of fabric 10 wherein the ends are joined by a pin 24 passing through the loops 20 to provide an endless belt of fabric 10. This is a preferred method of making endless the fabric 10, but other means such as the use of clipper hooks may be employed.

As stated above, the preferred fabric of the invention is a unitary, multi-layer structure free of binder yarns. The yarns 12, 14 and 12', 14' are integrated with the core yarns 16, 18 by a lengthwise yarn 12 or 12' which occasionally dips inwardly to interweave with a crosswise monofilament yarn 16 in the fabric core as shown in FIGS. 1 and 5 providing what is known in the art as stitching points. The entire fabric structure 10 may be characterized as a smooth faced, multi-layer weave. The fabric 10 may be woven on a conventional papermakers felt loom in a single operation. The base yarns 16, 18 are woven while the spun yarns 12, 14 and 12', 14' are woven directly over the base yarns 16, 18. The combining of the two yarn systems is performed during the weaving operation by sinking one of the spun yarns 12 or 12' to interlace with one of the monofilament base yarns 16 to provide the stitching points. The combining of the two systems is preferably in a set sequence, for example, on every other crosswise yarn 16 as shown in FIG. 1 so as not to distort either the spun yarn surfaces or the monofilament yarn base.

The density of the warp yarns in the woven fabric of the invention would depend on the size of the yarn selected and may advantageously range from between 10 to 180 warp ends to the inch. Similarly, the number of crosswise or filling yarns may be between 10 to 60 yarns per inch. Within these density ranges, the outer surface acts as a heat barrier as the fabric 10 passes over the corrugator steam chests with the interposed corrugator board. The density ranges described above also assure that the surface will be non-marking towards corrugated board being conveyed thereby.

Figure 2:
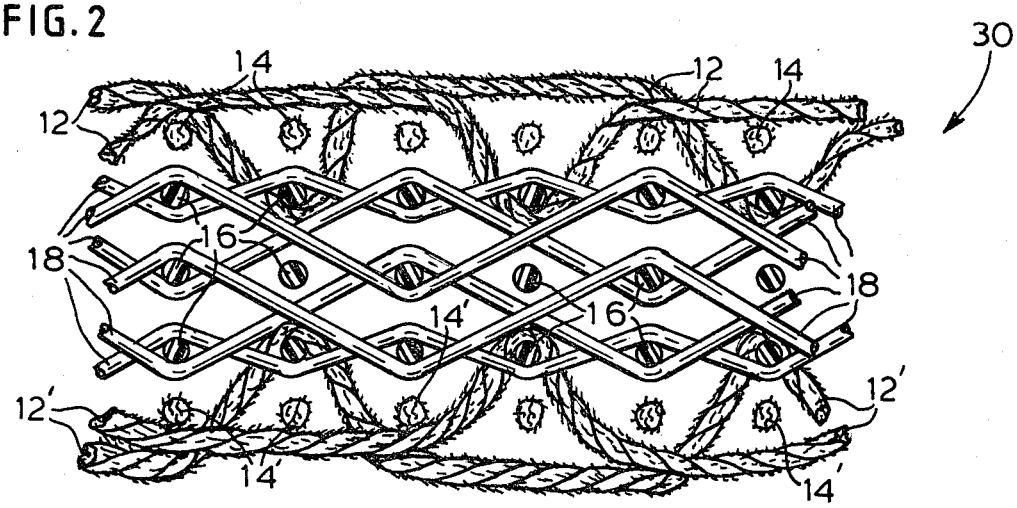
FIG. 2 is a view as in FIG. 1, but showing another embodiment fabric of the invention.

Referring now to FIG. 2, there is seen a cross-sectional side elevation of another embodiment fabric 30 of the invention. In FIG. 2, those structures which are similar to those shown in the embodiments of FIG. 1 are numbered alike. The embodiment of FIG. 2 however is an alternate weave wherein the core is a 3-layer weave of the monofilaments 16, 18.

Figure 3:
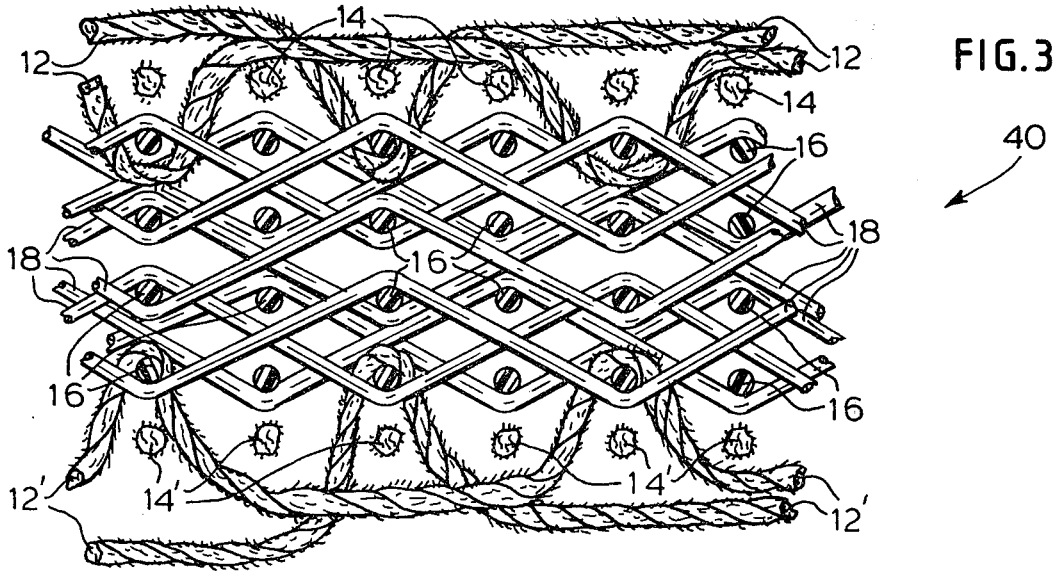
FIG. 3 is a cross-sectional side elevation of another embodiment fabric of the invention.

FIG. 3 is a cross-sectional, side elevation of another embodiment fabric 40 of the invention, where the core or base of the fabric is a 4-layer weave as in FIG. 1. The fabric 40 differs from the fabric 10 of FIG. 1 only in the weave pattern. In fabric 10, the lengthwise monofilament yarns 18 traverse the whole of the 4-layers making up the base while in fabric 40 the same yarns traverse only 2 layers of the same 4-layer weave, with overlapping of adjacent layers by the woven yarns 18. The lengthwise yarns 18 directly engage crosswise yarns 16 at the stitching points previously described, for anchoring the surface layers.

Figure 4:
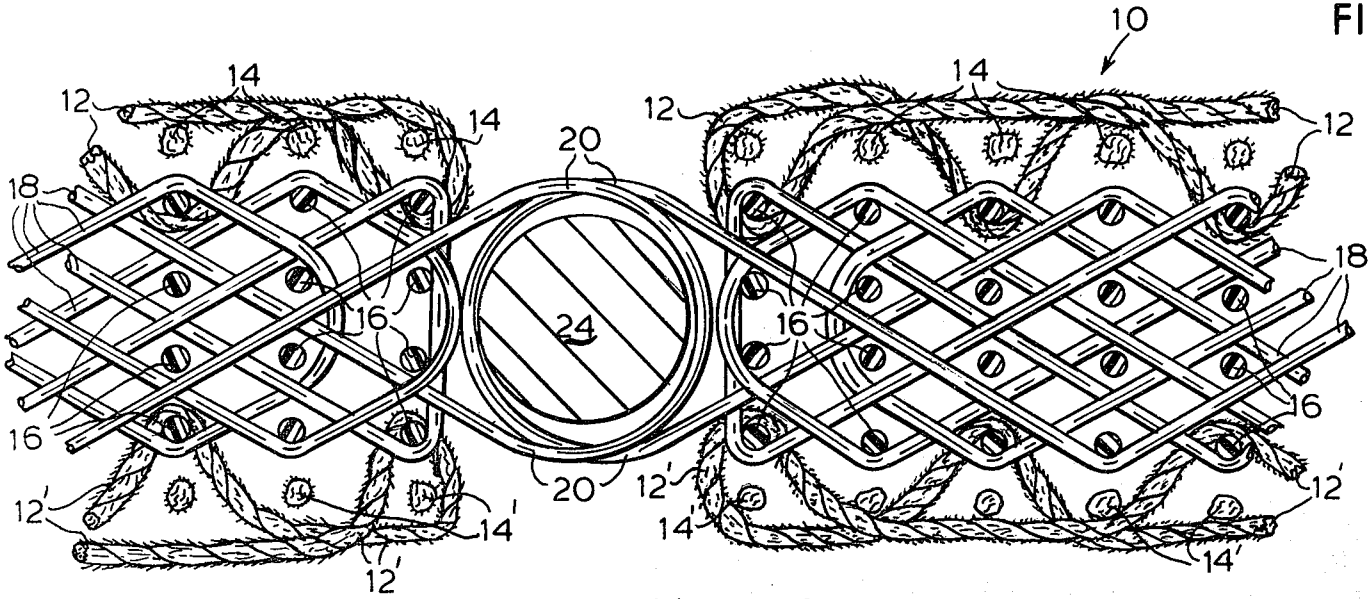
FIG. 4 is a cross-sectional side elevation of the two ends of the embodiment fabric of the invention of FIG. 1, shown joined endless.

In a preferred embodiment of the invention, a pin seam may be incorporated into the monofilament base fabric as described above and a spun yarn flap can then be created over the pin seam area. The spun yarn flap may be coextensive with the soft, outer layers of the fabric of the invention as shown in FIG. 5. FIG. 5 is a view of the joined ends of fabric 10 as shown in FIG. 4. However in the pin seam area of the joined ends, a "flap" 32 and a "flap" 32' have been formed at the upper and lower surface layers of interwoven yarns 12, 14 and 12', 14' respectively. The flaps 32, 32' cover the pin 24 and the seam area to continue a smooth, non-marking surface for the endless belt formed from fabric 10. The flap gives the appearance of and acts like a completely smooth, uninterrupted surface. Without the flap, an opening in the fabric would be present in the pin seam area.

Figure 6:
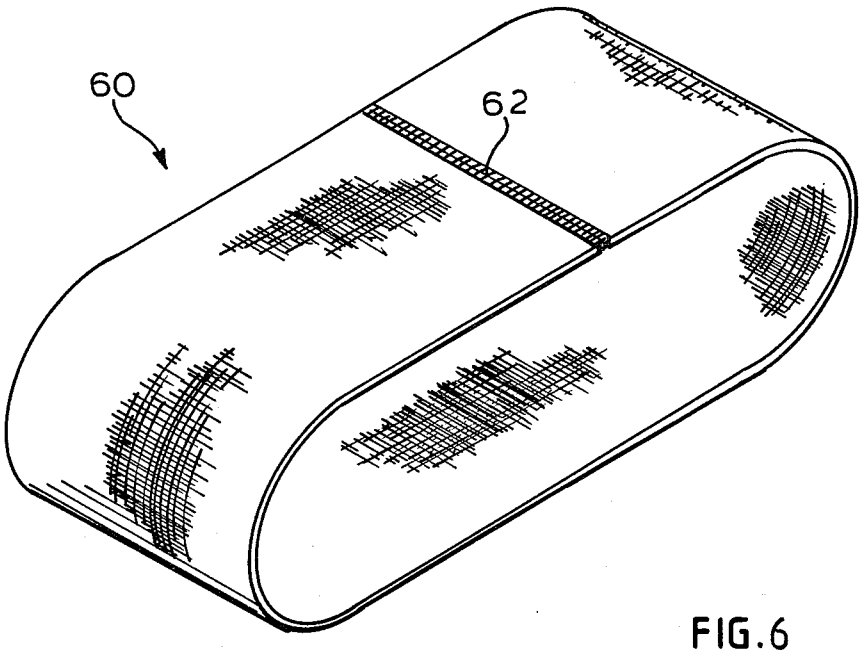
FIG. 6 is a view-in-perspective of an endless corrugator belt of the invention made up from a fabric of the invention.

FIG. 6 is a view-in-perspective of an endless belt 60 made up from the fabric of the invention, seamed together at seam 62. The endless belt 60 may be mounted on a conventional corrugator machine to make corrugator medium (board).

The following example describes the manner and process of making and using the invention and sets forth the best mode contemplated by the inventors of carrying out the invention but is not to be construed as limiting.

EXAMPLE 1

There is provided a quantity of 0.020 inch diameter polyester monofilament and a quantity of 0.028 inch diameter polyester monofilament yarn. There is also provided a quantity of 500 grain per 100 yard size 3-ply spun polyester yarns. The monofilament yarns are woven together in a four-layer duplex pattern, i.e; a multiple system of filling with a single system of warp yarns to form a base. The spun yarn is simultaneously woven on top and bottom of the woven monofilaments so as to surface cover the woven monofilaments, alternate spun yarns dropping down to interlace with alternate crosswise monofilaments.

The density of the monofilament warp yarns in the product is 80 ends to the inch in conjunction with 40 ends of spun yarn.

The ends of the product are frayed to break the ends and monofilament loops hand-woven back to provide a seamed structure. The ends are joined with a pin through the loops to obtain an endless corrugator belt. When installed on a corrugator machine as a corrugator belt, the fabric performs well in the manufacture of corrugated board. The belt tracks well, is easily guided and exhibits a long life.

The belts of the invention may be finished in any conventional manner, i.e.; by heat setting and by chemical treatments to offer specific properties of runability and resistance to chemical and abrasive degradation.

Those skilled in the art will appreciate that many modifications to the above-described preferred embodiments may be made without departing from the spirit and the scope of the invention. For example, binder threads may be employed in addition to the stitching point if so desired. Also, it is not necessary that both surface layers of the fabric of the invention be made of soft, textile yarns. Only one surface need be of soft, textile yarns, to contact the corrugator board. The drive side of the fabric surface layer may be made more abrasion resistant if woven from monofilament yarns such as those described for yarns 16, 18. In an even more preferred embodiment, the monofilament yarns in this surface layer are woven so that the crosswise yarns are in the outermost zone of the layer and the machine direction yarns are within that zone so they are protected from exposure to abrasive elements on the corrugator machine, such as the drive rolls.

What is claimed:

1. A multi-layer, flat woven, high permeability, composite fabric, useful in forming the body of an endless corrugator machine belt and having an air permeability of at least 10 and up to 2000 cubic feet per minute which comprises;

a multi-layer base of interwoven machine direction and cross-machine direction synthetic polymeric resin monofilament yarns;

said base being sandwiched between surface layers, at least one of which is of interwoven, soft textile yarns;

said layers of soft textile yarns being secured to the base by an interweaving of the soft textile yarns with the base yarns.

2. The fabric of claim 1 wherein the soft textile yarns are secured to the base by stitching points.

3. The fabric of claim 1 wherein the soft textile yarn layers are secured to the base by a third binder warp system.

4. The fabric of claim 1 wherein said soft textile yarns are spun yarns selected from the group consisting of yarns spun from polyester, polyamide, polyacrylic, wool or other staple fibers and mixtures thereof.

5. The fabric of claim 1 wherein said base yarns are monofilaments selected from the group consisting of polyester, polyamide, polypropylene and polyimide.

6. The fabric of claim 5 wherein said monofilaments have a diameter in the range of from 0.008 to 0.040 inches.

7. The fabric of claim 1 wherein the ends are joined by a pin seam to form an endless belt.

8. The belt of claim 7 wherein said pin seam is covered by a flap of woven spun yarn continuous with said soft surface.

9. The belt of claim 1 wherein both surface layers are of interwoven, soft textile yarns.

10. A corrugator belt which comprises;

an endless, multi-layer, flat woven composite fabric having a duplex weave base of interwoven machine direction and cross-machine direction synthetic polymeric resin monofilaments and a soft surface of spun yarns which interweave with yarns of the woven base to provide stitching points which secure the surface yarns to the base, said fabric having an air permeability of at least 10 and up to 2000 cubic feet per minute.

* * * * *